US005857583A

United States Patent [19]

Chantaca et al.

[11] Patent Number: 5,857,583

[45] Date of Patent: Jan. 12, 1999

[54] FOOD SERVICE CONTAINER WITH BEVERAGE CUP HOLDING POCKET AND COVERED FOOD COMPARTMENT

[75] Inventors: Annette M. Chantaca, Gurnee, Ill.; Keith C. Higginson, South Windham, Me.

[73] Assignee: Tenneco Packaging, Evanston, Ill.

[21] Appl. No.: 932,475

[22] Filed: Sep. 18, 1997

[51] Int. Cl.[6] ..... B65D 1/36

[52] U.S. Cl. ..... 220/523; 206/564; 220/555; 220/556; 229/406; 229/904

[58] Field of Search ..... 190/17; 206/6.1, 206/518, 564; 217/8, 14, 12 A, 28, 29, 56, 57; 220/4.03, 4.27, 4.23, 4.22, 575, 527, 522, 517, 516, 675, 253, 556, 23.86, 523, 525, 555, 23.83; 229/406, 407, 904; 383/61

[56] References Cited

U.S. PATENT DOCUMENTS

| | | | |
|---|---|---|---|
| D. 214,075 | 5/1969 | Pregont . | |
| D. 384,275 | 9/1997 | DuBois et al. . | |
| 2,924,372 | 2/1960 | Kirkeby . | |
| 3,295,737 | 1/1967 | Page et al. . | |
| 3,394,869 | 7/1968 | Fontana et al. | 229/120.03 X |
| 3,542,280 | 11/1970 | Crabtree . | |
| 3,608,770 | 9/1971 | Naimoll . | |
| 3,633,785 | 1/1972 | Cyr et al. | 229/406 X |
| 3,799,386 | 3/1974 | Madalin et al. | 220/23.8 X |
| 3,876,130 | 4/1975 | Haase | 220/4.23 X |
| 3,915,371 | 10/1975 | Crabtree . | |
| 3,999,661 | 12/1976 | Jones | 229/406 X |
| 4,208,006 | 6/1980 | Bixler et al. . | |
| 4,218,008 | 8/1980 | Veilleux | 229/406 |
| 4,431,128 | 2/1984 | Dirico | 229/904 X |
| 4,653,685 | 3/1987 | Leary et al. . | |
| 4,821,931 | 4/1989 | Johnson | 220/23.86 X |
| 4,966,297 | 10/1990 | Doty . | |
| 5,094,355 | 3/1992 | Clark et al. . | |
| 5,301,871 | 4/1994 | Gross et al. | 229/904 X |
| 5,323,926 | 6/1994 | Pomroy et al. | 229/406 X |
| 5,335,787 | 8/1994 | Finchum et al. . | |
| 5,368,183 | 11/1994 | Singer . | |
| 5,416,305 | 5/1995 | Tambellini . | |
| 5,421,459 | 6/1995 | Mazzotti . | |
| 5,449,071 | 9/1995 | Levy . | |
| 5,497,885 | 3/1996 | Sussman . | |

*Primary Examiner*—Allan N. Shoap
*Assistant Examiner*—William Walter Hutchinson
*Attorney, Agent, or Firm*—Arnold White & Durkee

[57] ABSTRACT

A food service container comprises a tray and a lid preferably composed of a leak-resistant, absorptive moldable material such as molded fiber. The tray has a first body portion and a first rim encompassing and projecting laterally outwardly from the first body portion. The first body portion has a primary food storage compartment and at least one beverage cup holding pocket. The beverage cup holding pocket forms resilient, deflectable side wall sections allowing the pocket to firmly hold beverage cups of different sizes. The lid is hingedly mounted to the tray. The lid includes a second body portion and a second rim encompassing and projecting laterally outwardly from the second body portion. The lid is moveable between an open position and a closed position. When the lid is in the closed position, the lid covers the primary food storage compartment.

16 Claims, 4 Drawing Sheets

FOOD SERVICE CONTAINER WITH BEVERAGE CUP HOLDING POCKET AND COVERED FOOD COMPARTMENT

FIELD OF THE INVENTION

The present invention relates generally to disposable carry-out fast food and beverage containers. More particularly, the invention relates to a food service container having both a covered food compartment and a pocket designed to hold beverage cups of different sizes.

BACKGROUND OF THE INVENTION

Occupational demands are increasingly requiring consumers to eat their meals away from home while traveling in vehicles or waiting in airport, bus, and railway terminals. As a result, carry-out service at restaurants has gained in popularity. These restaurants may provide their carry-out customers with one carry-out container for holding food and either another carry-out container or no container at all for holding a beverage. Alternatively, the carry-out customers may be provided with a single container having an open compartment for holding food and a pocket for holding a beverage cup.

Carry-out food and beverage provided in the above manner are not conducive to being transported in a vehicle or being comfortably carried by a carry-out customer with one hand. For example, if the food and beverage are held in a single container with an open food compartment, the food can easily spill out of the open compartment. If the food is heated prior to being served to the customer, a problem is that the open compartment does not retain the heat. Further, carrying the food and beverage may interfere with the ability of the customer to handle other items, which, in the case of a business traveler, could include luggage, a briefcase, a portable computer, etc. If the carry-out customer is attempting to handle such other items along with the carry-out food and beverage, the customer may accidently drop one of the items or spill the food or beverage.

SUMMARY OF THE INVENTION

Accordingly, an object of the present invention is to provide a food service container that can hold food in a covered compartment and can accommodate beverage cups of different sizes. The covered compartment maintains the integrity of food contained therein by preventing that food from spilling out of the container. Moreover, the covered compartment retains the heat of heated foods contained therein.

Another object of the present invention is to provide a food service container that is conducive to being transported in a vehicle and being comfortably carried with one hand.

A further object of the present invention is to provide a food service container that is disposable and compact and allows a consumer to eat directly from the container.

In accordance with one embodiment of the present invention, the foregoing objectives are realized by providing a food service container including a tray and a lid preferably composed of a leak-resistant, absorptive moldable material such as molded fiber. The tray has a first body portion and a first rim encompassing and projecting laterally outwardly from the first body portion. The first body portion has a primary food storage compartment and at least one beverage cup holding pocket. The beverage cup holding pocket forms resilient, deflectable side wall sections allowing the pocket to firmly hold beverage cups of different sizes. The lid is hingedly mounted to the tray. The lid includes a second body portion and a second rim encompassing and projecting laterally outwardly from the second body portion. The lid is moveable between an open position and a closed position. One of the lid and the tray preferably includes a tab, while the other of the lid and the tray includes a slot. When the tab is inserted into the slot, the lid and the tray are engaged, thereby maintaining the lid in the closed position.

Depending upon the needs of the particular application involved, the tray may include secondary food storage compartments. When the lid is in the closed position, the lid may cover only the primary food storage compartment while leaving the secondary compartments exposed. Alternatively, the lid may cover both the primary compartment and one or more of the secondary compartments. In addition, the lid may be positioned in several different configurations and connected to a perimeter of the tray in several locations.

BRIEF DESCRIPTION OF THE DRAWINGS

Other objects and advantages of the invention will become apparent upon reading the following detailed description and upon reference to the drawings in which.

Figure 1A:
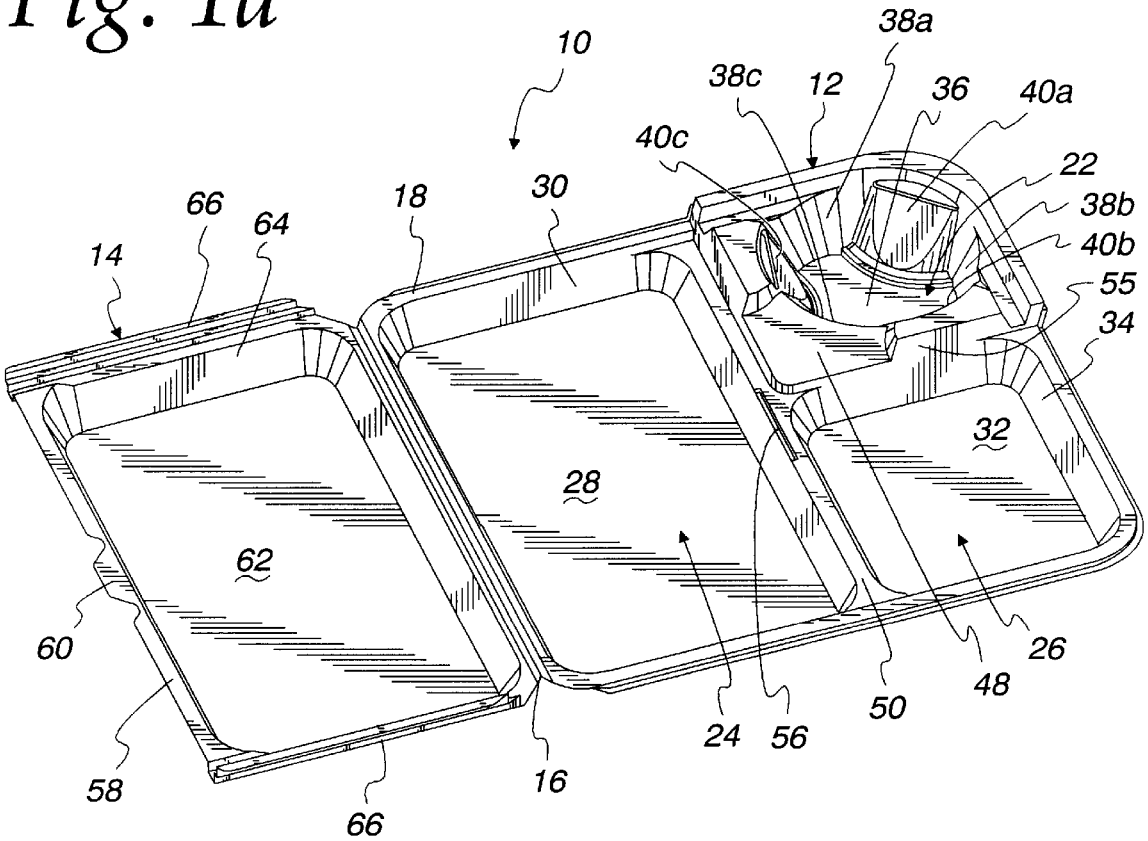
FIG. 1*a* is an isometric view of a food service container containing a beverage cup holding pocket in accordance with a first embodiment of the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF ILLUSTRATIVE EMBODIMENTS

With respect to elements common to the food service containers in the drawings, and in particular to the beverage cup holding pocket shown in each of the figures, some reference numerals are not included in each figure to avoid unnecessary clutter of reference numerals. It should, however, be understood that beverage cup holding pocket shown in each figure is substantially identical in construction.

Figure 1B:
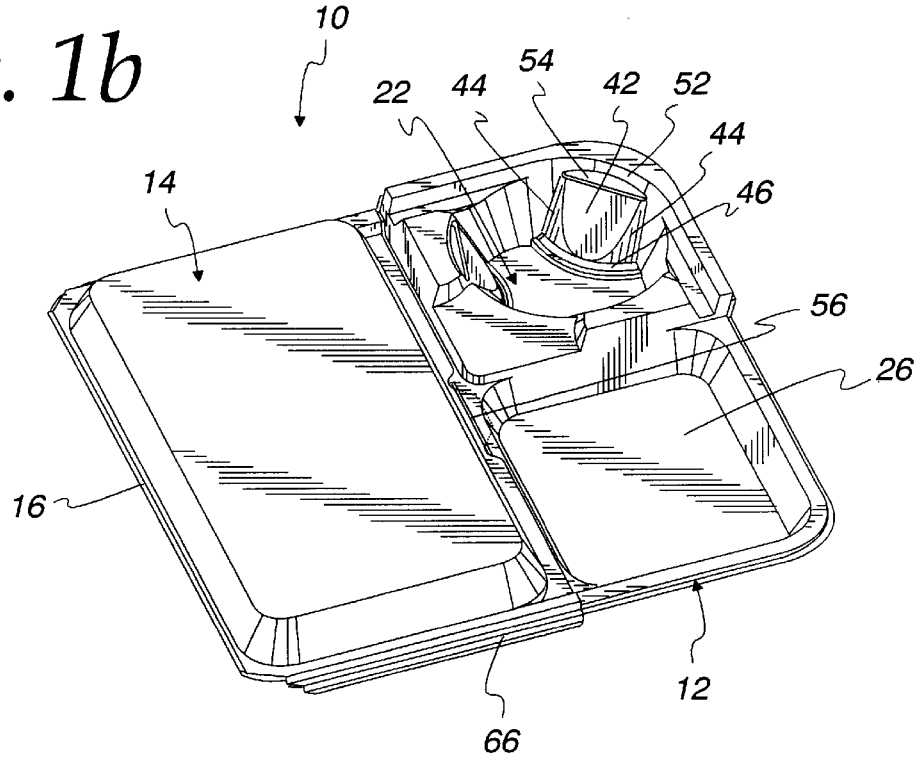
FIG. 1*b* is an isometric view of the food service container shown in FIG. 1*a*, showing the lid in the closed position.

Turning now to FIGS. 1*a* and 1*b*, there is shown a food service container 10 in accordance with one embodiment of the present invention. The food service container 10 includes a tray 12 and a lid 14 preferably composed of a leak-resistant, absorptive moldable material such as molded fiber. Molded fiber is an advantageous material because it absorbs food juices in a controlled manner but does not allow these juices to completely bleed through to the exterior surface of the material. Tray 12 and lid 14 are hingedly connected by hinge 16. In FIG. 1*a* the food service container is shown with lid 14 in the open position, while in FIG. 1*b* lid 14 is shown in the closed position.

The tray 12 includes a continuous first body portion and a continuous rim 18 which encompasses the entire first body portion 20. In this particular embodiment, the first body portion includes a beverage cup holding pocket 22, a primary food storage compartment 24, and a secondary food storage compartment 26, though it should be apparent to one skilled in the art that this arrangement may be varied without departing from the spirit and scope of the invention as long as at least one food storage compartment and one beverage cup holding pocket remain.

Primary food storage compartment 24 is defined by bottom wall 28 and continuous side wall 30. Continuous side wall 30 encompasses bottom wall 28 and extends upwardly and outwardly from bottom wall 28. Like primary food storage compartment 24, secondary food storage compartment 26 is defined by bottom wall 32 and continuous side wall 34. Continuous side wall 34 encompasses bottom wall 32 and extends upwardly and outwardly from bottom wall 32.

Beverage cup holding pocket 22 includes bottom wall 36, a plurality of generally conical side wall portions 38*a–c*, and a plurality of circumferentially spaced webs 40*a–c*. The plurality of side wall portions 38*a–c* preferably include three side wall portions circumferentially spaced at equal distances from each other. Side wall portions 38*a–c* encompass bottom wall 36 and extend upwardly and outwardly from bottom wall 36. Side wall portions 38*a–c* form surface portions of a curved surface of an imaginary inverted cone having an imaginary point located below bottom wall 36. In alternate embodiments having additional beverage cup holding pockets akin to pocket 22, one imaginary inverted cone would be associated with each beverage cup holding pocket 22—a different imaginary inverted cone defining the side wall portions 38*a–c* of each pocket.

Webs 40*a–c* interconnect side wall portions 38*a–c* and extend radially inward from the curved surface of the imaginary inverted cone. Each of the webs 40*a–c*includes a generally flat central section 42 (see FIG. 1*b*) and a pair of opposing side sections 44 (see FIG. 1*b*) connecting central section 42 to adjacent ones of the conical side wall portions 38*a–c*. Central section 42 extends upwardly and outwardly from bottom wall 36 and is either planar or curved slightly outward relative to the interior of the pocket. The pair of opposing side sections 44 of each of the webs 40*a–c* forms surface portions of a curved surface of a respective imaginary upright cone having an imaginary point located above the level of tray 12. Central section 42 of each of the webs 40*a–c* defines a truncated parabolic conic section of the respective imaginary upright cone.

With respect to the three webs 40*a–c* of the beverage cup holding pocket, a respective imaginary upright cone defines the pair of opposing side sections 44 as well as the truncated parabolic conic section 42 of each web. Therefore, three imaginary upright cones are needed to define the pairs of opposing side sections 44 and the truncated parabolic conic sections 42 of the three respective webs 40*a–c* of an individual beverage cup holding pocket 22.

Each of the webs 40*a–c* of a particular beverage cup holding pocket 22 is vertically spaced from bottom wall 36 to define a respective first elongated slot 46 (see FIG. 1*b*) therebetween. The first elongated slot 46 is curvilinear in shape and is bounded by a curved lower edge of the respective web 40*a–c* and a curved outer edge of the bottom wall 36. An outwardly curved rim portion 52 (see FIG. 1*b*) is disposed above and spaced from the central section 42 of each of the webs 40*a–c* to define a respective second elongated slot 54 (see FIG. 1*b*) therebetween. The second elongated slot 54 is bounded by a straight upper edge of the respective central section 42 and a curved lower edge of the respective rim portion 52.

Beverage cup holding pocket 22 is designed to accommodate beverage cups of different sizes. When a beverage cup is inserted into pocket 22, the cup causes webs 40*a–c* to deflect outward and conform around the inserted cup. The amount of deflection of webs 40*a–c* depends upon the size of the cup. Since webs 40*a–c* are resilient, they apply inward pressure to a base and lower portion of the beverage cup to firmly grip it. This minimizes the possibility that the cup will become disengaged from the pocket 22 and spill its contents during transport. In response to removing the beverage cup from pocket 22, resilient webs 40*a–c* return to their original nondeflected positions. Further details concerning construction and operation of the beverage cup holding pocket 22 may be obtained from U.S. patent application Ser. No. 7 08/596,516 filed Feb. 5, 1996, entitled "Beverage Cup Carrier," and incorporated herein by reference in its entirety.

As the beverage cup holding pocket 22 is generally round, adaptations are made so that it can be compatible, within the tray 12, with the generally linear sides of the food storage compartments 24, 26. To that end, beverage cup holding pocket 22 includes a generally horizontal logo platform 48 shaped so as to fill the void between the rounded side wall portion 38*c* and the linear edges of food storage compartments 24, 26. Logo platform 48 provides advertising space for embossing or application of a label.

Tray 12 also contains primary tray partition 50 which is generally defined by continuous side wall 30 associated with primary food storage compartment 24; continuous side wall 34 associated with secondary food storage compartment 26; and logo platform 48. Secondary tray partition 55 is generally defined by logo platform 48 and continuous side wall 34 associated with secondary food storage compartment 26. Primary tray partition 50 and secondary tray partition 55 are useful in that they separate the different foods which may be placed in food storage compartments 24, 26 and minimize the passage of food juices between the food storage compartments 24, 26.

In the present embodiment, primary tray partition 50 forms slot 56 positioned generally at the lengthwise midpoint of primary tray partition 50. As shown in FIG. 1*b*, slot 56 is adapted to releasably engage with tab 60 formed by lid 14 such that when so engaged, lid 14 is maintained in a closed position. While the present embodiment is shown with the present arrangement of tab and slot, those skilled in the art will recognize that changes to the number of tabs and slots, as well as to the physical placement of those tabs and slots, may be made without departing from the spirit and scope of the present invention. Moreover, alternative latching means for maintaining the lid in the closed position may be employed. Examples of such alternative latching means are disclosed in U.S. Pat. Nos. 5,094,355, 5,046,659, 4,742,934, 4,715,529, 4,582,248, and 4,463,894, which are incorporated herein by reference in their entireties.

As stated above, lid 14 is hingedly connected to tray 12 by hinge 16. Hinge 16 is generally parallel to primary tray partition 50, the two being separated from each other by primary food storage compartment 24. Lid 14 includes a continuous second body portion 62, 64 and a continuous rim 58 which encompasses the entire second body portion. Continuous rim 58 is constructed to form tab 60. The second body portion is defined by top wall 62 and continuous side wall 64. Side wall 64 encompasses top wall 62 and extends downwardly and outwardly therefrom when lid 14 is in the closed position. In this particular embodiment, the dimensions and shape of second body portion 62, 64 are generally similar to the shape and dimensions of primary food storage compartment 24, such that when lid 14 is in the closed position, only primary food storage compartment 24 is covered.

Lid 14 also contains a pair of flanges 66 which are positioned perpendicular to hinge 16 and are separated from each other by second body portion 62, 64. When lid 14 is in the closed position, flanges 66 extend downwardly and outwardly from continuous rim 58 and over the respective adjacent portions of continuous rim 18 of tray 12. As a result, flanges 66 help to maintain lid 14 in the closed position and more completely enclose primary food storage compartment 24, thereby minimizing leakage of food juices out of container 10.

Figure 2A:
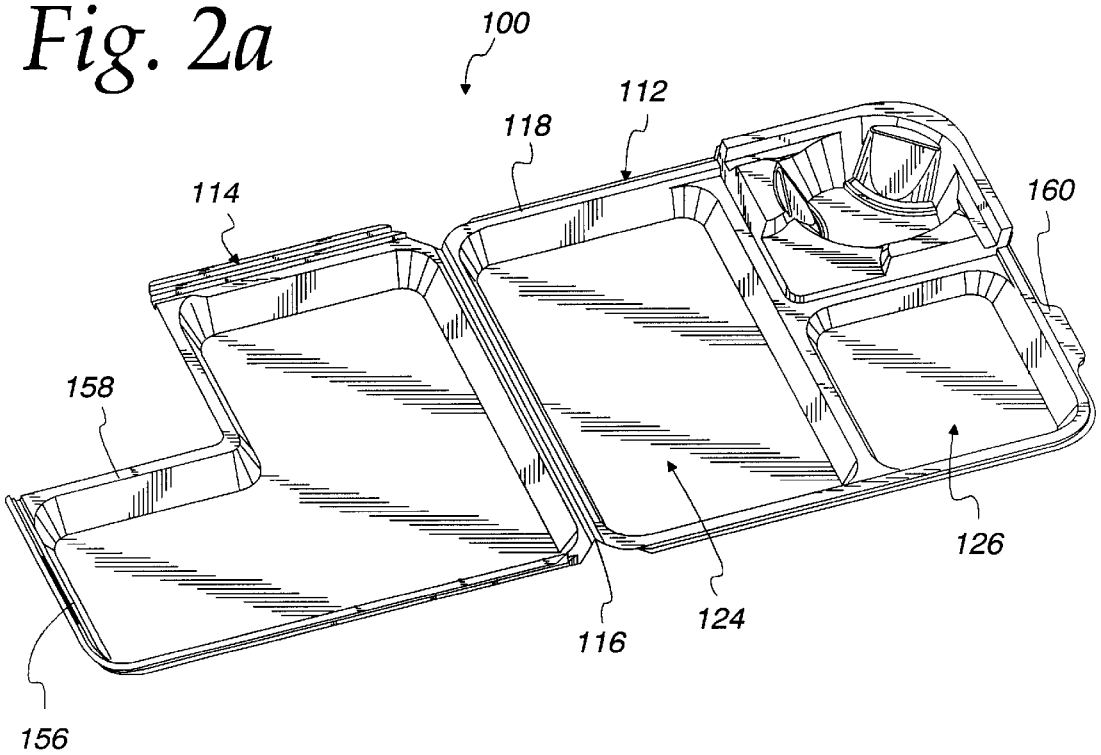
FIG. 2*a* is an isometric view of a food service container in accordance with a second embodiment of the present invention.
Figure 2B:
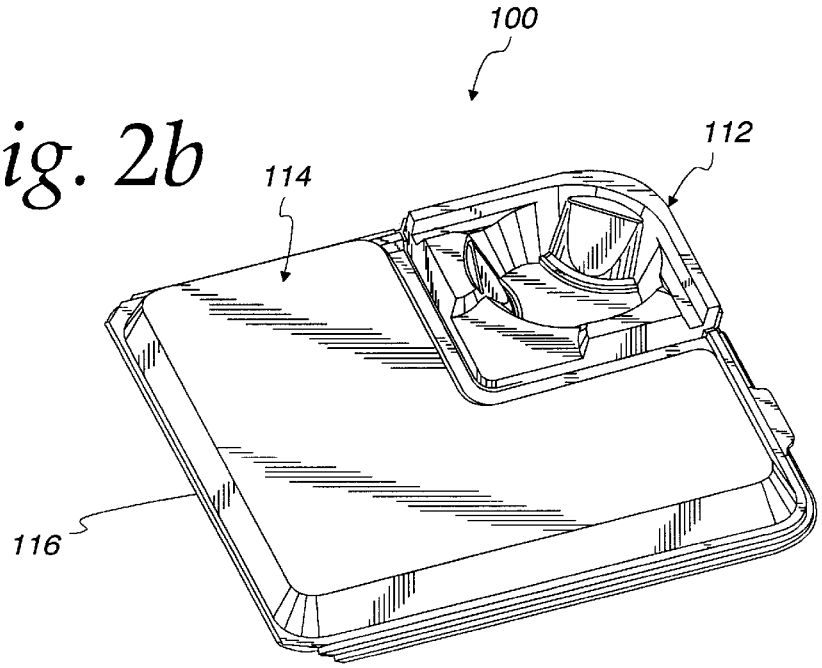
FIG. 2*b* is an isometric view of the food service container shown in FIG. 2*a*, showing the lid in the closed position.

FIGS. 2*a* and 2*b* depict a food service container 100 that is similar to that shown in FIGS. 1*a* and 1*b*. In FIG. 2*a* the food service container 10 is shown with lid 114 in the open position, while in FIG. 2*b* lid 114 is shown in the closed position. One difference between this embodiment and the one shown in FIGS. 1*a* and 1*b* is that lid 114 has been enlarged such that it has the shape and dimensions sufficient to cover both primary food storage compartment 124 and secondary food storage compartment 126. Also, this particular embodiment illustrates how the positions of tab 160 and slot 156 may be changed, yet still retain the spirit and scope of the invention. Here, tab 160 has been moved to tray 112 and positioned on continuous rim 118 on the opposite side of tray 112 from hinge 116. Consequently, slot 156 has been moved to lid 114 and positioned on continuous rim 158 of lid 114 such that slot 156 can engage with tab 160 when lid 114 is in the closed position.

Figure 3A:
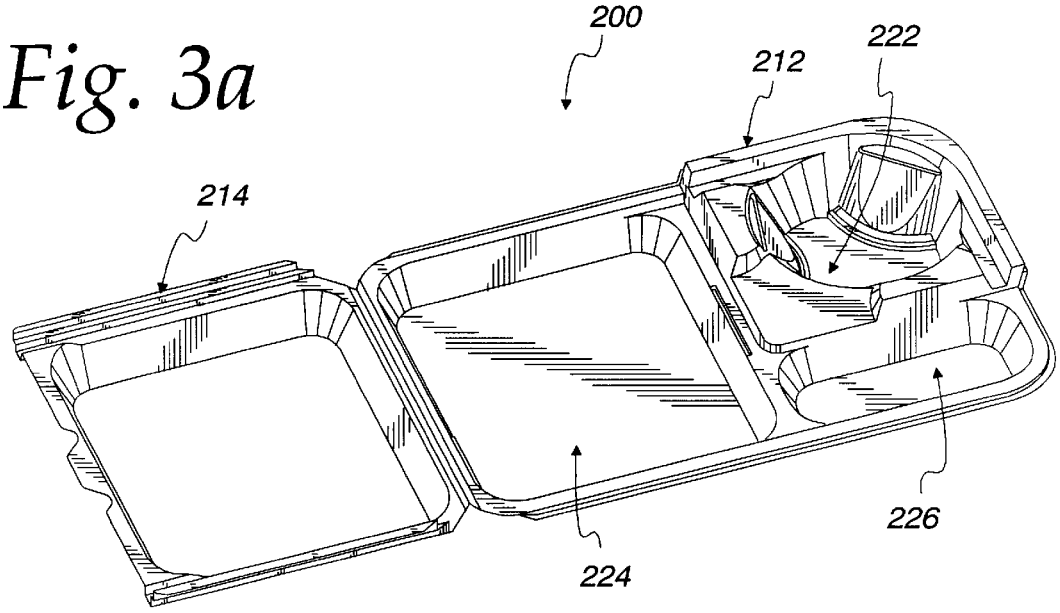
FIG. 3*a* is an isometric view of a food service container in accordance with a third embodiment of the present invention.
Figure 3B:
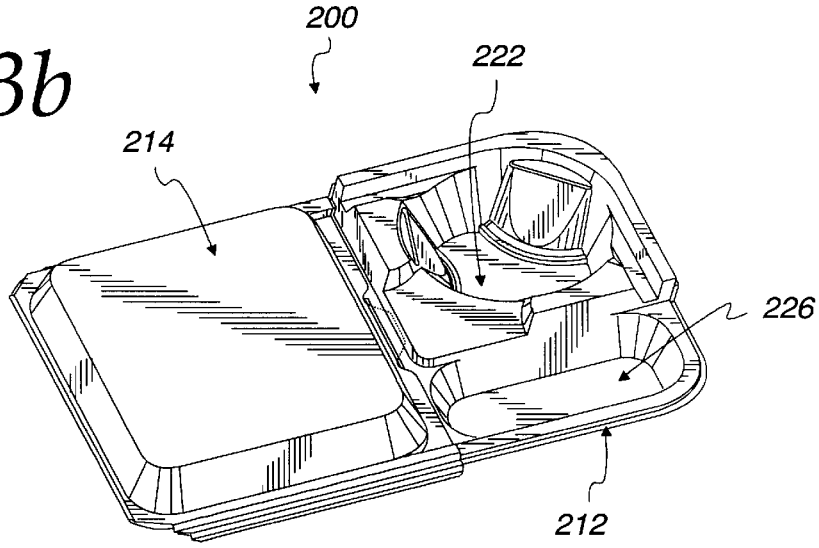
FIG. 3*b* is an isometric view of the food service container shown in FIG. 3*a*, showing the lid in the closed position.

FIGS. 3*a* and 3*b* depict a food service container 200 that is also similar to that shown in FIGS. 1*a* and 1*b*. In FIG. 3*a* the food service container 200 is shown with lid 214 in the open position, while in FIG. 3*b* lid 214 is shown in the closed position. One difference between this embodiment and the one shown in FIGS. 1*a* and 1*b* is that the dimensions of most of the components, with the exception of beverage cup holding pocket 222 and its associated elements, have been altered. For example, in this embodiment, primary food storage compartment 224 is generally square in shape while secondary food storage compartment 226 is generally rectangular in shape. It will be readily apparent to one skilled in the art that these changes have not altered the spirit or scope of the present invention.

Figure 4A:
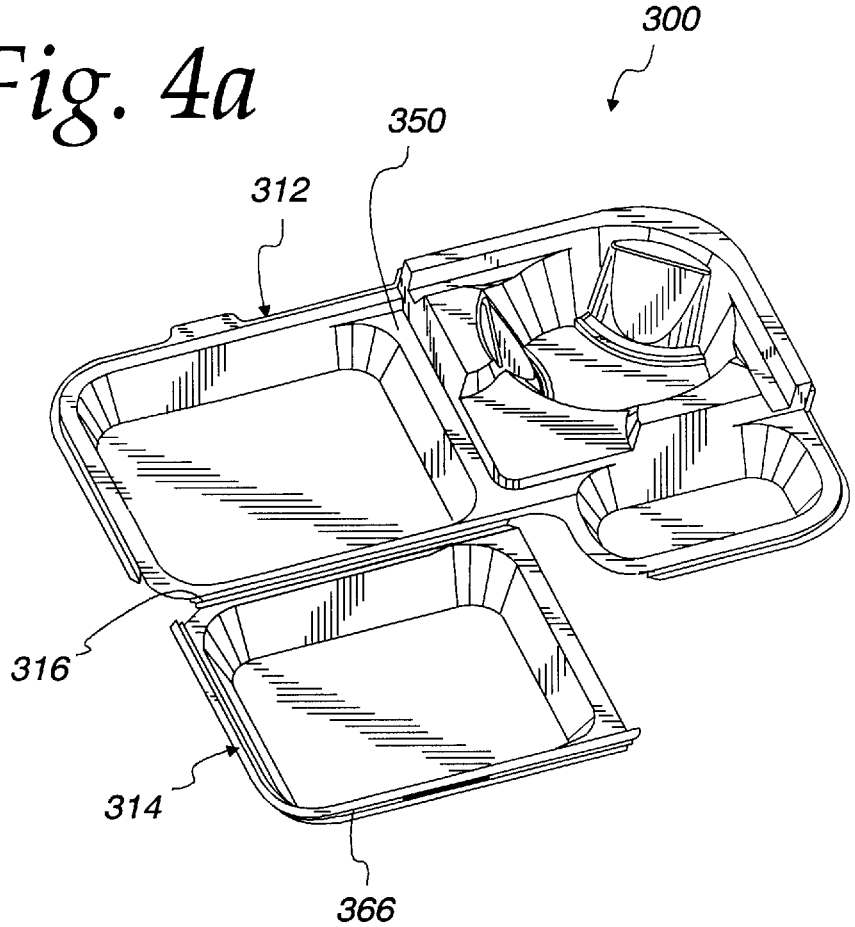
FIG. 4*a* is an isometric view of a food service container in accordance with a fourth embodiment of the present invention.
Figure 4B:
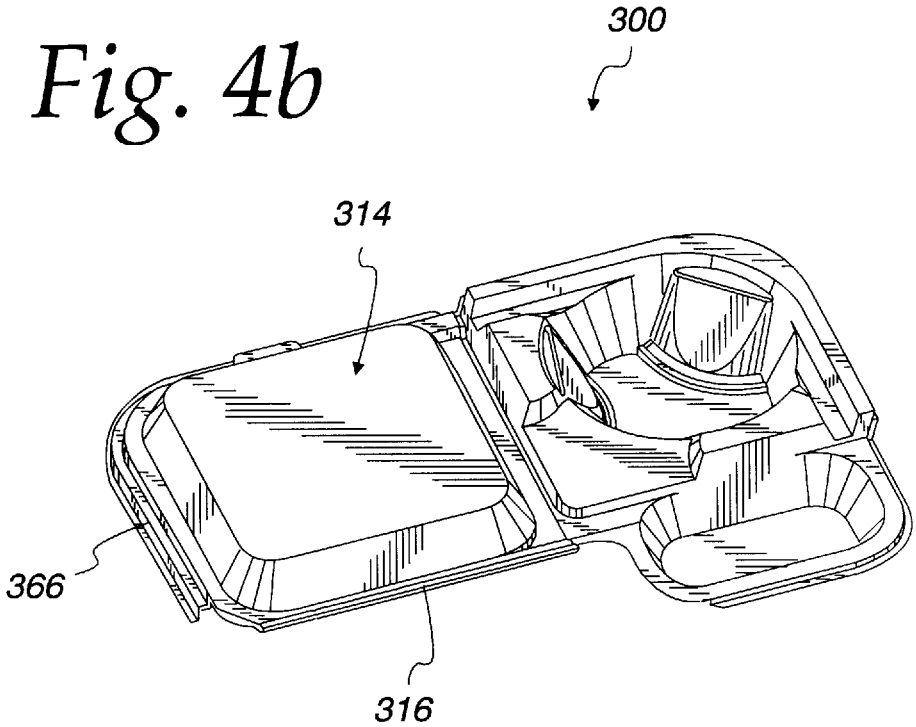
FIG. 4*b* is an isometric view of the food service container shown in FIG. 4*a*, showing the lid in the closed position.

Finally, FIGS. 4*a* and 4*b* depict a food service container 300. In FIG. 4*a* the food service container 300 is shown with lid 314 in the open position, while in FIG. 4*b* lid 314 is shown in the closed position. One difference between this embodiment and the one shown in FIGS. 1*a* and 1*b* is that hinge 316 has been positioned perpendicular, instead of parallel, to primary tray partition 350. This causes lid 314 to move in an arc which is generally perpendicular to the arc through which the lid has moved in previous embodiments. Also, flanges 66 (see FIG. 1*a*) of the previous embodiments have been combined into one unitary, L-shaped flange 366 which encompasses the side of lid 314 opposite hinge 316 as well the adjacent exterior side of lid 314.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A food service container comprising:

a tray having a first body portion, said first body portion including an outer side wall, and a first rim encompassing and projecting laterally outwardly from said first body portion and beyond said outer side wall, said first rim including side portions adjacent said primary food storage compartment, said first body portion having a primary food storage compartment and at least one beverage cup holding pocket, said pocket having resilient, deflectable side wall sections allowing said pocket to firmly hold beverage cups of different sizes;

a lid hingedly mounted to said tray, said lid having a second body portion and a second rim encompassing and projecting laterally outwardly from said second body portion, said lid being moveable between an open position and a closed position, said lid covering said primary food storage compartment but not said beverage cup holding pocket when said lid is in said closed position; and said tray and said lid being constructed from a disposable material.

2. The food service container of claim 1, wherein one of said lid and said tray includes a tab and the other of said lid and said tray includes a slot, said tab being inserted into said slot to maintain said lid in said closed position.

3. The food service container of claim 1, wherein said first body portion includes a secondary food storage compartment.

4. The food service container of claim 3, wherein said lid covers said primary food storage compartment and said side portions of said first rim when said lid is in said closed position said first rim when said lid is in said closed position.

5. The food service container of claim 3, wherein said lid covers said primary food storage compartment and said secondary food storage compartment when said lid is in said closed position.

6. The food service container of claim 1, wherein said primary food storage compartment is separated from said pocket by a tray partition, and wherein said lid is hingedly connected to said tray by a hinge.

7. The food service container of claim 6, wherein said hinge is generally parallel to said tray partition.

8. The food service container of claim 6, wherein said hinge is generally perpendicular to said tray partition.

9. The food service container of claim 1, wherein said disposable material is a leak-resistant, absorptive moldable material.

10. The food service container of claim 9, wherein said moldable material is molded fiber.

11. The food service container of claim 1, wherein said primary food compartment is defined by a bottom wall and a first side wall, said first side wall encompassing said bottom wall and extending upwardly and outwardly therefrom.

12. The food service container of claim 11, wherein said second body portion includes a top wall and a second side wall, said second side wall encompassing said top wall and extending downwardly and outwardly therefrom when said lid is in said closed position.

13. A food service container comprising:

a tray having a primary food storage compartment and at least one beverage cup holding pocket, said pocket having resilient, deflectable side wall sections allowing said pocket to firmly hold beverage cups of different sizes, said side wall sections applying inward pressure to said beverage cup to grip said beverage cup, thereby minimizing spillage in transport said tray having a bottom, an upstanding permetrical side wall and rim, said side wall having an outer surface, said rim extending laterally beyond said outer side surface;

a lid hingedly mounted to said tray, said lid being moveable between an open position and a closed position, said lid covering said primary food storage compartment but not said beverage cup holding pocket when said lid is in said closed position; and said tray and said lid being constructed from a disposable material.

14. The food service container of claim 13, wherein said disposable material is a leak-resistant, absorptive moldable material.

15. The food service container of claim 14, wherein said moldable material is molded fiber.

16. A food service container comprising:

a tray having a first body portion, said first body portion including an outer side wall, and a first rim encompassing and projecting laterally outwardly from said first body portion and beyond said outer side wall, said first rim including side portions adjacent said primary food storage compartment, said first body portion having a primary food storage compartment and at least one beverage cup holding pocket, said pocket having resilient, deflectable side wall sections allowing said pocket to firmly hold beverage cups of different sizes;

a lid hingedly mounted to said tray, said lid having a second body portion and a second rim encompassing and projecting laterally outwardly from said second body portion, said lid being moveable between an open position and a closed position, said lid covering said primary food storage compartment and part of said rim when said lid is in said closed position;

wherein said first body portion includes a secondary food storage compartment; and wherein said lid covers said primary food storage compartment and said side portions of said first rim when said lid is in said closed position said first rim when said lid is in said closed position.

* * * * *